United States Patent [19]

Frayer et al.

[11] 4,170,545

[45] Oct. 9, 1979

[54] MULTISTAGE RESIDUAL OIL HYDRODESULFURIZATION PROCESS WITH AN INTERSTAGE FLASHING STEP

[75] Inventors: James A. Frayer, Pittsburgh; Harry C. Stauffer, Cheswick; Stephen J. Yanik, Valencia, all of Pa.

[73] Assignee: Gulf Research and Development Company, Pittsburgh, Pa.

[21] Appl. No.: 843,877

[22] Filed: Oct. 20, 1977

[51] Int. Cl.[2] ..... C10G 23/02

[52] U.S. Cl. ..... 208/210

[58] Field of Search ..... 208/210, 89

[56] References Cited

U.S. PATENT DOCUMENTS

| | | | |
|---|---|---|---|
| 3,663,434 | 5/1972 | Bridge | 208/210 |
| 3,968,031 | 7/1976 | Frayer et al. | 208/210 |

*Primary Examiner*—George Crasanakis

[57] ABSTRACT

In the hydrodesulfurization of residual oil the amount of hydrogen consumed per atom of sulfur removed is relatively low until the desulfurization becomes deep, whereupon the amount of hydrogen consumed per atom of sulfur removed becomes relatively high. The present invention provides a multistage catalytic hydrodesulfurization process capable of producing products of low sulfur level while avoiding deep desulfurization of the heavy portion of the residual oil so that hydrogen consumption is diminished. The feed oil and hydrogen are passed through an upstream hydrodesulfurization stage and the upstream stage effluent is flashed to separate a distillate oil fraction from a concentrated residual oil fraction. A portion of the concentrated residual oil fraction is diverted from the process for use as refinery fuel and the remaining portion of the flash residue and hydrogen are charged to an upstream stage together with the flash distillate. Since the sulfur in distillate oil is less refractory than the sulfur in residual oil, removal of a portion of the concentrated residual oil fraction provides a nonaliquot distillate-residual oil downstream stage feed stream which is easier to desulfurize to a low sulfur level than an aliquot distillate-residual oil stream. The dilution of the high sulfur residue in the downstream stage diminishes the depth of hydrodesulfurization required for residual components in the downstream stage, thereby reducing the level of hydrogen consumption required to produce a product having a low sulfur level.

6 Claims, 2 Drawing Figures

Figure 1:
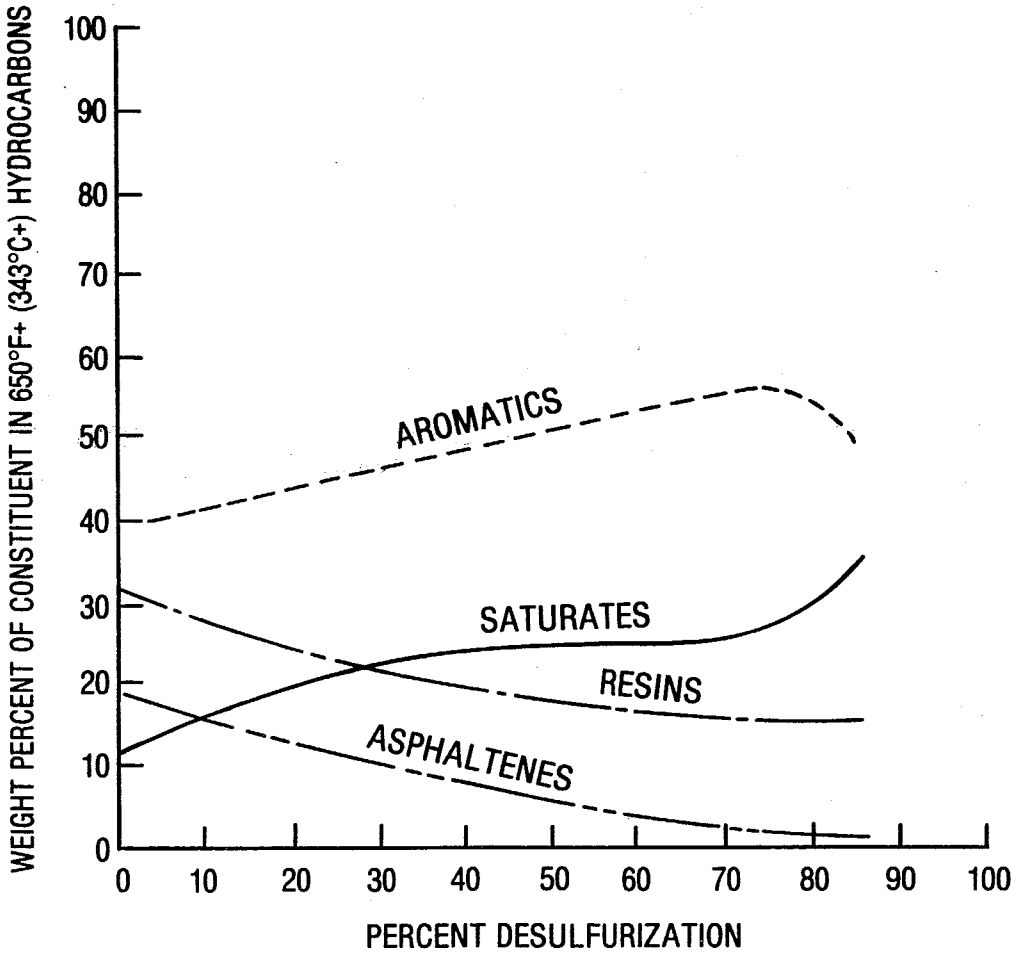

MULTISTAGE RESIDUAL OIL HYDRODESULFURIZATION PROCESS WITH AN INTERSTAGE FLASHING STEP

This invention relates to a multistage process for the catalytic hydrodesulfurization of residual oils containing metals, sulfur and asphaltenes.

When residual oils, such as petroleum residuals, are desulfurized in the presence of molecular hydrogen, the hydrogen consumption economy of the desulfurization reaction decreases as the depth of sulfur removal increases. For example, in the catalytic hydrodesulfurization of a 650° F.+(343° C.+) Kuwait reduced crude oil containing 4 weight percent sulfur, it was found that removal of 3 of the 4 weight percent sulfur present in the oil to reduce the sulfur content of the oil to 1 weight percent requires a hydrogen consumption of about 500 standard cubic feet per barrel (9 SCM/100 L), providing a hydrogen efficiency of 167 standard cubic feet of hydrogen (4.68 $M^3$) per percent of sulfur in the oil which is removed. The removal of the next 0.7 weight percent increment to reduce the sulfur content of the oil to 0.3 weight percent requires a hydrogen consumption of 165 standard cubic feet per barrel (2.97 SCM/100 L), providing a hydrogen efficiency of 236 standard cubic feet of hydrogen (6.61 $M^3$) per percent of sulfur in the oil which is removed. Finally, the removal of an additional 0.2 weight percent sulfur increment to reduce the sulfur content of the oil to 0.1 weight percent requires a hydrogen consumption of 170 standard cubic feet per barrel (3.07 SCM/100 L), providing a hydrogen efficiency of 850 standard cubic feet of hydrogen (23.8 $M^3$) per percent of sulfur in the oil which is removed. These data show that with removal of progressively deeper increments of sulfur from the residual oil the hydrodesulfurization process becomes progressively hydrogen inefficient as evidenced by the fact that removal of the final 0.2 weight percent increment of sulfur in the oil requires about 5 times the hydrogen consumption per atom of sulfur removed as compared to the hydrogen consumption during the removal of the first 3 weight percent increment of sulfur in the oil.

We have now discovered a method for the multistage desulfurization of residual oil which provides a desulfurized product having a relatively low sulfur level while avoiding deep, hydrogen-inefficient hydrodesulfurization of the heavy portion of the residual oil. The present invention involves a series multi-stage hydrodesulfurization operation including removal of a portion of a concentrated high boiling residual oil stream between upstream and downstream stages. At the same time, a concentrated distillate fraction is prepared for the downstream stage independently of the residual fraction. The stream entering the downstream stage contains a non-aliquot proportion of distillate to residual components as compared to the feed oil since it is impoverished or depleted of feed residual components although it contains most or all of the distillate components of the feed oil to the hydrodesulfurization process. Since the sulfur in the distillate oil is relatively nonrefractory, the dilution of residual components with distillate oil relieves the downstream stage of the necessity of accomplishing extremely deep desulfurization of refractory residual components in order to produce a low sulfur effluent stream.

One method of obtaining a non-aliquot distillate-residual oil second stage stream which is relatively enriched in distillate components is to distill a crude or reduced crude feed oil containing substantially all of the asphaltenes of the full crude to prepare separate distillate and residual oil fractions for hydrodesulfurization. According to this method, the residual fraction is passed to a first or upstream hydrodesulfurization stage while the distillate fraction by-passes the upstream stage and is passed directly to a second or downstream stage. A portion of the residual oil fraction is removed between the stages, and the greater the amount of distillate oil removed at the feed distillation column the more concentrated in residual components will be the oil removed between the stages and the greater will be the dilution of the non-removed residual components when blended with the distillate fraction in the downstream stage.

It is apparent that the hydrogen efficiency advantage of the above-described process increases with increases in the ratio of distillate to residual oil components in the second stage stream. However, any increase in the size of the distillate fraction prepared at the feed distillation column necessitates an increase in the heat cost of distillation. The present invention provides a method for accomplishing the separation of distillate and residual components in the hydrodesulfurization operation with a diminished distillations energy consumption by utilizing the exothermic heat of the hydrodesulfurization reaction in the first or upstream stage to accomplish at least part of the separation of distillate from residual oil. According to this invention, the hot effluent from the first hydrodesulfurization stage is passed to a separation chamber to flash a distillate fraction from residual material. For example, the chamber can conveniently produce an overhead stream including a 375° to 650° F. (191 to 343° C.) fraction using the exothermic heat generated in the first hydrodesulfurization stage. The amount of distillate produced at the interstage flash can be increased by adding heat to the interstage flash chamber which is obtained from a source other than the upstream hydrodesulfurization stage. Also, a vacuum can be applied to the interstage flash chamber. Thereby, a distillate fraction of any suitable boiling range can be taken overhead from the interstage flashing step. An amount ranging between about 10, 20 or 30 up to 50, 65 or 75 weight percent of the flash residue is removed from the process and the interstage distillate fraction is passed to the second or downstream stage together with the remaining portion of the flash residue. In this manner, the exothermic heat of the first stage hydrodesulfurization reaction is utilized to at least partially separate distillate from residual components so that a portion of the concentrated residual oil fraction can be removed from the process, whereby a non-aliquot distillate-residual oil second stage stream can be prepared which is relatively enriched in distillate components. If desired, the second stage stream can be further enriched in distillate components by the addition thereto of an extraneous distillate stream.

The present invention has particular utility where the concentrated residue stream removed from the process between the hydrodesulfurization stages is utilized as a refinery fuel. The permissible sulfur levels for fuels employed in a refinery are generally higher than for fuels prepared for general commercial consumption. In the event that the sulfur level of the removed residue exceeds the maximum permissible level for refinery use, the removed residue can be blended with one or more relatively low sulfur, low value streams available in a refinery, such as cycle oil or decanted oil. The availability of these low sulfur low value streams in a refinery contributes to the utility of the removed residue as refinery fuel.

Figure 2:
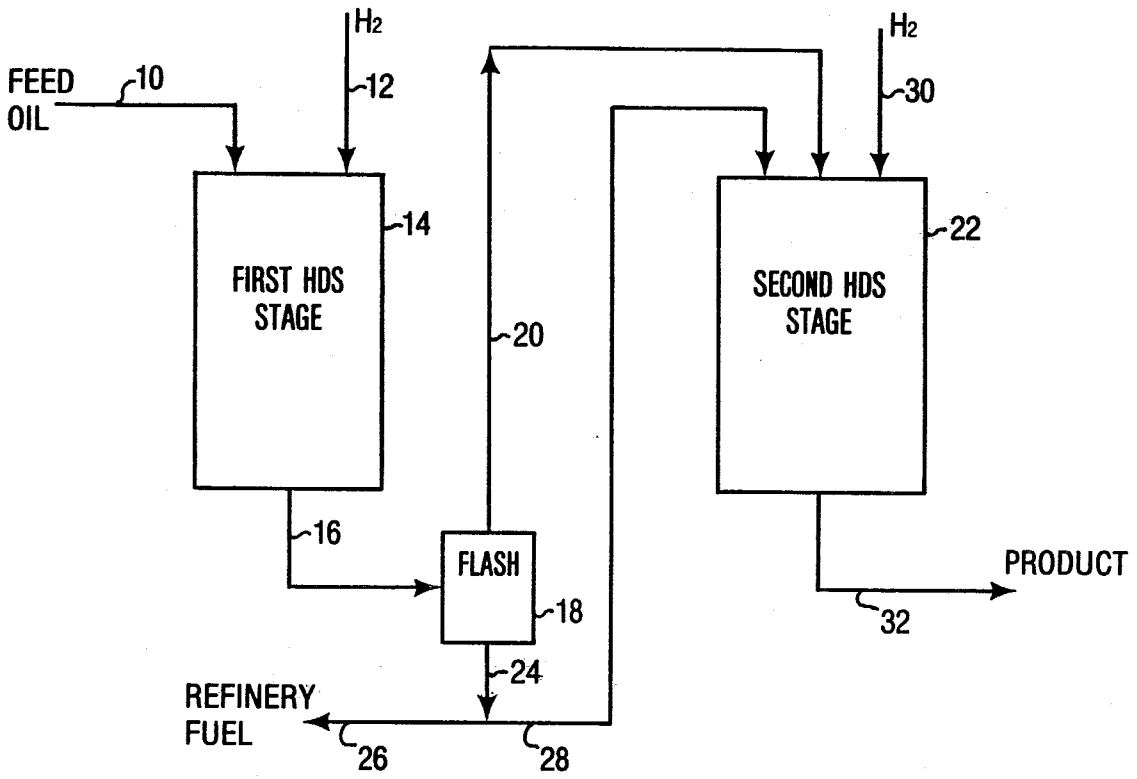

The present invention is illustrated in FIGS. 1 and 2 wherein FIG. 1 shows the proportions of aromatics, saturates, resins and asphaltenes in a residual oil as the oil experiences progressive hydrodesulfurization, and FIG. 2 shows a process scheme for performing this invention.

The decrease in the hydrodesulfurization duty of the process resulting from an increase in the aliquot ratio of distillate to residue components in the stream being treated is illustrated by the data of Table 1. Table 1 shows the volume percent of various boiling range fractions and the sulfur content of each fraction in a hydrodesulfurization effluent stream containing 0.15 weight percent sulfur obtained by hydrodesulfurization of a 650° F.+(343° C.+) Kuwait residual oil containing 4 weight percent sulfur.

TABLE 1

| TBP FRACTION | VOL. % OF TOTAL YIELD | WT. % SULFUR IN FRACTION | % OF TOTAL SULFUR IN PRODUCT |
|---|---|---|---|
| IBP-375° F. (IBP-191° C.) | 1.62 | 0.04 | 0.38 |
| 375°-650° F. (191°-343° C.) | 13.71 | 0.04 | 3.50 |
| 650°-1065° F. (343°-574° C.) | 68.11 | 0.09 | 40.84 |
| 1,065° F.+ (574° C.+) | 16.56 | 0.47 | 55.28 |

Table 1 shows that more than half of the total sulfur in the product is contained in the highest boiling 16.56 volume percent fraction of the total yield, which is the 1065° F.+(574° C.+) fraction. Therefore, if half of the 1065° F.+(574° C.+) product fraction could be utilized as refinery fuel, removal of this segment would constitute removal of only about 8 volume percent of the stream but would accomplish removal of about 28 weight percent of the total sulfur in the stream. It is seen that removal of a relatively small volumetric portion of the total stream, when the removed portion is a concentrated residue fraction, substantially diminishes the sulfur concentration in a remaining non-aliquot distillate-residue stream. The method of this invention thereby greatly reduces the depth of hydrodesulfurization required to produce an ultimate product having a low sulfur level. In this manner, a product having a low sulfur level can be produced with a relatively high hydrogen efficiency.

The data of Table 1 indicate that the most refractory sulfur in a residual oil is concentrated in the highest boiling fraction, which is the asphaltene-containing fraction. Asphaltenes are non-distillable. However, some of the non-distillable asphaltenes in the feed oil are upgraded to distillate material via hydrodesulfurization in the first stage, leaving the most refractory asphaltenes in the first stage effluent. This is illustrated by FIG. 1, herein, which was also presented in U.S. Pat. No. 3,761,399, and which shows the proportions of aromatics, saturates, resins and asphaltenes in a 650° F.+(343° C.+) residual oil as the oil experiences progressive catalytic hydrodesulfurization. The resins and asphaltenes comprise the residue of a propane extraction of the oil. Resins and asphaltenes are subsequently separable by a pentane extraction since resins are soluble in pentane while asphaltenes are not. As shown in FIG. 1, the resin and asphaltene content of the oil steadily decreases with increasing hydrodesulfurization. This decrease is due to the severing of carbon-sulfur bonds, thereby breaking off molecular fragments. The accumulation of these molecular fragments is reflected in FIG. 1 by the indicated build-up of lower molecular weight saturates and aromatics. When the desulfurization level reaches about 75 percent, the resin and asphaltene content of the oil becomes stable, indicating little additional severing of molecular fragments therein. At the same time, the total aromatics and saturates content also tends to stabilize, with any increase in saturates level being accompanied by a decrease in aromatics level. This indicates that after about 75 percent desulfurization the process tends to consume hydrogen by hydrogenation of aromatics, which represents a fruitless consumption of hydrogen.

It has been observed in conventional residual oil hydrodesulfurization processes which produce a very low sulfur residual oil product, requiring more than about 90 or 95 weight percent desulfurization, the unconverted asphaltenic material in the product becomes highly incompatible with the lower boiling oils and tends to settle out of solution. This incompatibility may arise because the hydrogen consumed during deep desulfurization is selectively acquired by the lower boiling oils, as indicated by the increase in saturates level in FIG. 1, while refractory asphaltenes are impervious to hydrogenation, thereby inducing a widened differential in the hydrogen to carbon ratios of the unconverted asphaltenes and the hydrogenated oils. The removal of a portion of a concentrated stream of asphaltenes from the process reduces the level of hydrogenation required to produce a low sulfur product so that the stability of the refractory asphaltenes remaining in the hydrodesulfurized oil tends to be improved.

FIG. 1 shows that a substantial portion of the feed asphaltenes (the general term "asphaltenes" as used herein includes both asphaltenes and resins, since both are non-distillable materials) can be converted to saturates and aromatics in an upstream hydrodesulfurization stage. The demonstration in FIG. 1 that a substantial portion of the feed asphaltenes can be converted in an upstream hydrodesulfurization stage is the reason that a portion of the asphaltenes is not removed directly from the feed oil in the process of the present invention. By removing asphaltenes from an upstream stage effluent stream rather than directly from the feed oil, the asphaltene removal is selective towards refractory asphaltenes. The demonstration in FIG. 1 that an attempt to convert the refractory asphaltenes is extremely difficult and results in a wasteful consumption of hydrogen, as evidenced by a conversion of aromatics to saturates, is the reason that a portion of the refractory asphaltenes is removed in advance of the downstream stage.

Data were also presented in U.S. Pat. No. 3,761,399 showing that in a non-desulfurized residual oil the sulfur concentration in the various fractions are relatively uniform and that it is in the course of the hydrodesulfurization operation that the highest sulfur concentration devolves to the high boiling refractory asphaltene fraction. Table 2 shows the progressive changes in sulfur concentration occurring in various fractions during two stage catalytic hydrodesulfurization of a reduced crude oil containing 4.09 weight percent sulfur. The 650° F.+(343° C.+) product of the first stage had a sulfur content of 1.09 weight percent while the corresponding second stage effluent oil contained 0.58 weight percent sulfur.

TABLE 2

| | Feed to first stage (4.09 wt. % sulfur) | | Feed to second stage (1.09 wt. % sulfur) | | Product from second stage (0.58 wt. % sulfur) | |
|---|---|---|---|---|---|---|
| Percent by wt.: | Fraction | Sulfur in Fraction | Fraction | Sulfur in Fraction | Fraction | Sulfur in Fraction |
| Saturates | 17.98 | 3.42 | 22.24 | 0.80 | 22.34 | 0.49 |
| Aromatics | 55.45 | 5.04 | 60.45 | 1.12 | 61.91 | 0.56 |
| Resins | 16.73 | 5.59 | 13.76 | 2.37 | 12.72 | 1.56 |
| Asphaltenes | 9.84 | 6.99 | 3.55 | 4.95 | 3.03 | 3.13 |

Table 2 shows that the suflur levels in the various fractions of the feed oil are relatively uniform. However, during passage of the feed oil thrugh the first hydrodesulfurization stage the saturates and aromatics lose sulfur to the greatest extent, while the resins and asphaltenes lose sulfur to the least extent. The same occurs during second stage hyrodesulfurization.

Table 3 contains data from U.S. Pat. No. 3,761,399 which show the effect of catalytic hydrodesulfurization upon the boiling range of a residual oil. In the tests of Table 3, the reduced crude was hydrodesulfurized in three stages.

TABLE 3

| | Feedstock | Effluent from each of three desulfurization stages | | |
|---|---|---|---|---|
| Sulfur, percent by wt. | 5.43 | 4.77 | 1.41 | 0.83 |
| Boiling range, °F. | 566–1,400+ (297°–560° C.+) | 514–1,400+ (268°–560° C.+) | 509–1,400+ (265°–560° C.+) | 466–1,400+ (241°–560° C.+) |
| Desulfurization, percent | — | 12.2 | 74.0 | 85.0 |

The data of Table 3 show that while the first 74 percent of the sulfur in the oil was being removed, the IBP of the oil was reduced from 556° to 509° F. (297° to 265° C.), or 57° F. (32° C.), while the attempt to reduce the sulfur content only slightly further to achieve 85 percent desulfurization induced reduction of the IBP to 466° F. (241° C.), or an additional 43° F. (24° C.). These data show that the first 74 percent desulfurization has a relatively small effect upon boiling point reduction, while the removal of the more refractory sulfur has a greater effect upon boiling point reduction. It is a significant feature of the present invention that since desulfurization is achieved in part by a dilution effect in place of deep hydrodesulfurization, the process of the present invention can diminish even the small amount of bioling point reduction shown in the above table, thereby reducing hydrogen consumption.

The catalyst of the first stage of a multi-stage residual oil hydrodesulfurization system is not greatly deactivated by coking because relatively reactive asphaltenes are available for conversion in the first stage. In multistage residual oil hydrodesulfurization processes, most of the sulfur is removed in the first stage. For example, the first stage generally removes 60, 70, 75 or more weight percent of the sulfur content in the feed oil. However, the more refractory asphaltenes pass unconverted through the firsrt stage and it is the sulfur in these refractory asphaltenes that conventionally must be removed in second or third hydrodesulfurization stages. Unfortunately, refractory asphaltenes are known coke formers and the removal of sulfur therefrom in a downstream stage is conducive to coke formation. Therefore, in conventional multistage hydrodesulfurization operations, while coke formation is not significant in the first stage, the second stage catalyst is generally deactivated by coke, and the deactivation of the second stage catalyst generally occurs more rapidly than the deactivation of the first stage catalyst. The coke problem in a second or third stage is the reason for the use of a specialized coke-resistant catalyst in downstram stages, such as the Group IV-B metal-promoted coke resistant second stage catalyst utilized in the process of U.S. Pat. No. 3,968,027.

The amount of coking in a second or subsequent hydrodesulfurization stage generally increases with the concentration of refractory asphaltenes in the oil stream flowing through those stages. Downstream hydrodesulfurization catalysts tend to induce coking via agglomeration and polymerization of refractory asphaltene molecules. These reactions occur because desulfurization catalysts are hydrogenation-dehydrogenation agents and since the asphaltenes in the downstream stages are refractory to hydrodesulfurization their residence time at the surface of the catalyst is extended, blocking access of hydrogen to the catalyst, and it is this inaccessibility of hydrogen which induces dehydrogenation and ultimately coking. Any increase in the concentration of refractory asphaltenes tends to increase the incidence of agglomeration and polymerization so that, conversely, in accordance with the present invention, the amount of coking in the second stage is reduced via removal of a portion of the refractory asphaltenes between the stages and by dilution of the non-removed asphaltenes prior to their entry into the second stage. The removal of a segment of the concentrated asphaltene stream flowing from the first stage in accordance with this invention constitutes selective removal of the most refractory molecules in the system. Dilution of the non-removed asphaltenes with partially desulfurized distillate oil shifts the desulfurization duty of the catalyst in the second and subsequent stages from the refractory heteroatom sulfur embedded within polycondensed aromatic rings of asphaltenic molecules to the more reactive thiophenic sulfur in distillate molecules.

The stream flowing through the second stage comprises a non-aliquot ratio of distillate to residual components since it contains most or all of the distillate components of the feed stream but has been deprived of a portion of the asphaltenic components. The diminished quantity of refractory asphaltenes entering the second stage will have the benefit of the dilution and viscosity reducing effects of most or all of the distillate portion of the feed oil. It was shown in U.S. Pat. No. 3,761,399 that the rate of hydrodesulfurization of a residual fraction can be improved by diluting the residual fraction with highly desulfurized gas oil, probably due to solubilizing of viscous, high molecular weight sulfur-containing molecules and improving their mass transfer in the system. That patent further showed that excessive dilution of a residual fraction with highly desulfurized gas oil can inhibit the rate of desulfurization of the residual fraction, probably due to excessive dispersal of the sulfur-containing molecules. However, the present invention tends to circumvent the problem of a diminished rate of second stage residual oil desulfurization. This invention permits a relaxation of dependence upon deep desulfurization of the residual fraction by practicing the interdependent operations of selective removal from the process of a concentrated stream of sulfur-refractory residual components and dilution of the non-removed residual components with the distillate portion of the feed oil, so that the oil flowing through the downstream stage comprises a non-aliquot mixture of residual and distillate components, as compared to the feed oil. In this manner, in a downstream stage the quantity of the most sulfur-refractory material in the feed oil is diminished resulting in an increase in the concentration of the most sulfur-reactive material in the feed, releasing the process from the burden of accomplishing a deep desulfurization of residual components in order to achieve a low sulfur product.

Since the refractory asphaltenes removed between the stages is the material which would have contributed most heavily to coking in the downstream stage, the total liquid yield of the process is enhanced by avoiding conversion of liquid material to coke. This advantageous yield effect provides a concomitant advantageous catalyst aging effect since diminution of coke formation in the downstream stage tends to extend the active life of the second stage catalyst.

The present invention relates to a plural stage process for the hydrodesulfurization of an asphaltene-containing residual oil in which at least two different streams of hydrodesulfurized residual oil are removed from the process with each removed stream having a different sulfur content and boiling range as it is separated from the process, without any product blending or product distillation step being required to accomplish these differences. One of the product residual oil streams has a narrow boiling range and a relatively high sulfur level while the other product residual oil stream has a wider boiling range and a relatively low sulfur level. The low sulfur residual oil stream is the primary product of the process and meets the demanding sulfur specifications for commercial fuels to be burned in densely populated areas. The relatively high sulfur level residual oil product has a higher average boiling point and meets the less demanding specifications for refinery fuels. As noted above, refinery fuels can utilize high sulfur streams because of the availability in refineries of low quality but low sulfur streams for blending, such as cycle oil or decanted oil. Removal of the refinery stream in the process of this invention avoids overtreating of that portion of the total stream, relative to its intended use, resulting in a significant savings in hydrogen, in extended catalyst life an in increased liquid yield in the process. The increased liquid yields results from reduced conversion to coke.

The hydrodesulfurization catalyst of all of the stages of the present process comprises at least one Group VI metal and at least one Group VIII metal on a non-cracking support. Suitable Group VI and Group VIII metal combinations include cobalt-molybdenum, nickel-tungsten and nickel-molybdenum. A preferred combination is nickel-cobalt-molybdenum. The catalyst support comprises a highly porous, non-cracking supporting material. Alumina is the preferred supporting material, but other porous, non-cracking supports can be employed, such as silica-alumina and silica-magnesia.

The catalyst in any downstream stage can be the same as or different from the catalyst employed in the first stage. For example, the proportions of catalytic metals can be the same or can be different. The composition of the downstream catalyst can be generally the same as the composition of the first stage catalyst except that it can contain a promoting amount of a Group IV-B metal, such as titanium, zirconium or hafnium, preferaby titanium. Promotion with a Group IV-B metal improves the resistance of the downstream catalyst to cpoking. However, removal of a portion of the refractory asphaltene stream in advance of the downstream stage in accordance with this invention diminishes the need for a coke-resistant downstream catalyst.

In the present process, the oil is passed downwardly through a fixed bed of catalyst in each stage. Very little hydrocracking occurs in the process. In general, at least 40 or 50 weight percent of the total hydrodesulfurizaton product boils above the IBP of the hydrodesulfurization feed oil and, preferably, at least 70, 80 or 90 weight percent of the hydrodesulfurization product boils above the IBP of the hydrodesulfurization feed oil. The hydrodesulfurization temperature should be sufficiently low that not more than 30 percent, generally, and preferably not more than about 20, 15 or even 10 percent of the 650° F.+(343° C.+) feed oil will be converted to material boiling below 650° F. (343° C.).

The hydrodesulfurization process of this invention employs in each stage a hydrogen partial pressure of 500 to 5,000 pounds per square inch (35 to 350 kg/cm$^2$), generally, 1,000 to 3,000 pounds per square inch (70 to 210 kg/cm$^2$), preferably, and 1,500 to 3,000 pounds per square inch (105 to 175 kg/cm$^2$), most preferably. The gas circulation rate in each stage can be between 1,000 and 20,000 standard cubic feet per barrel (17.8 and 356 SCM/100 L), generally, or preferably about 2,000 to 10,000 standard cubic feet per barrel (35.6 to 178 SCM/100 L). The gas circulated preferably contains 85 percent, or more, of hydrogen. The mol ratio of hydrogen to oil in each stage can be between about 4:1 and 80:1. Reactor temperatures can vary between about 600° and 900° F. (316° and 482° C.), generally and between about 650° and 800° F. (343° and 427° C.), preferably. Reactor temperatures are increased in each stage during a catalyst cycle to compensate for activity loss due to aging. The liquid hourly space velocity in each reactor can be between about 0.1 and 10, generally, and between about 0.2 and 1 or 2, preferably.

The process can be used for desulfurizing asphaltene-containing oils other than petroleum oils, such as coal liquids and oils extracted from shale and tar sands. Asphaltenes have a relatively low hydrogen to carbon ratio and will generally comprise less than half of the feed oil, but wil generally contain most of the metallic components present in the total feed, such as nickel and vanadium.

A process scheme for performing the present invention is illustrated in FIG. 2. As shown in FIG. 2, a topped crude oil in line 10, such as a 375° F.+(191° C.+), a 650° F.+(343° C.+), or any other suitable feed oil, and hydrobgen entering through line 12 are passed to first catalytic hydrodesulfurizaton stage 14. A first stage hdyrodesulfurized effluent in line 16 is apassed to flash chamber 18 and the heat generated in reactor 14 is utilized to flash an overhead stream of any desired boiling range, such as an overhead stream including a 375° to 650° F. (191° to 343° C.) fraction, through line 20 for independent passage to second catalytic hydrodesulfurization stage 22. If desired, heat from outside of the process can be added to flash chamber 18 by any suitable means, not shown, or a vacuum can be applied to fladh chamber 18, to increase the boiling range of the stream in line 20 and to further concentrate the high boiling components in the flash residue.

The flash residue is removed from chamber 18 through line 24 and a portion thereof is removed from the process through line 26 for use as refinery fuel. If desired, the refinery fuel in line 26 can be blended with a low sulfur refinery stream, such as decanted oil or cycle oil. The remaining portion of the flash residue from line 24 flows through line 28 and is passed to second catalytic hydrodesulfurization stage 22 together with hydrogen flowing rhough line 30. A second stage hydrodesulfurizaton effluent, which is the primary product of the process, is removed through line 32. The product stream in line 32 contains a non-aliquot proportion of distillate to residual oil, being relatively poorer in residual oil as compared to the feed oil in line 10, due to removal of the concentrated residual stream through line 26.

We claim:

1. A process for the hydrodesulfurization of an aromatics- and asphaltene-containing feed oil to produce at least two hydrodesulfurized residual oil streams having different respective asphaltene and sulfur contents, said process employing upstream and downstream hydrodesulfurization stages containing hydrodesulfurizaton catalyst comprising Group VI and Group VIII metal on a non-cracking support at a temperature between 600° and 900° F. and a hydrogen pressure between 500 and 5,000 psi, said process comprising passing said feed oil and hydrogen though said upstream hydrodesulfurization stage to produce an upstream stage deffluent stream, passing said upstream stage effluent stream through a flash zone to separate a flash distillate stream from a flash residue stream, splitting said flash residue stream into a first flash residue portion comprising between about 10 and 75 weight percent of said flash residue stream and a second flash residue portion, removing said first flash residue porton from said process to selectively remove refractory sulfur asphaltenes from said process and to increase the concentration of more sulfur-reactive material in said downstream stage, passing said second flash residue portion and said flash distillate stream and hydrogen to said downstream stage, and recovering a downstream stage effluent stream, said downstream stage effluent stream containing aromatics and having a sulfur concentration at least 75 percent lower than the sulfur concentration of said feed oil, the removal of said first flash residue portion allowing the sulfur concentraton in said downstream stage effluent stream to be achieved with a relatively high aromatics concentration as compared to the aromatics concentration when achieving the same sulfur concentration by hydrodesulfurization without selective removal of refractory sulfur asphaltenes.

2. The process of claim 1 wherein said first flash residue portion comprises between about 30 to 50 weight percent of said flash residue stream.

3. The process of claim 1 wherein said first flash residue portion comprises between about 20 and 65 weight percent of said flash residue stream.

4. The process of claim 1 wherein less than 30 percent of said feed oil boiling above 650° F. is cracked to material boiling below 650° F.

5. The process of claim 1 wherein less than 10 percent of said feed oil boiling above 650° F. is cracked to material boiling below 650° F.

6. The process of claim 1 wherein the downstream hydrodesulfurization stage catalyst includes a promoting amount of Group IV-B metal.

* * * * *